US009035178B2

(12) United States Patent
Gerstner et al.

(10) Patent No.: US 9,035,178 B2
(45) Date of Patent: May 19, 2015

(54) DOMESTIC APPLIANCE WITH AT LEAST A DISPLAY WINDOW

(71) Applicant: BSH Bosch und Siemens Hausgeräte GmbH, Munich (DE)

(72) Inventors: Norbert Gerstner, Herbrechtingen (DE); Tobias Merk, Dillingen (DE); Florian Racs, Heidenheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 212 days.

(21) Appl. No.: 13/737,978

(22) Filed: Jan. 10, 2013

(65) Prior Publication Data

US 2014/0160643 A1 Jun. 12, 2014

(30) Foreign Application Priority Data

Dec. 12, 2012 (DE) ..... 10 2012 222 955

(51) Int. Cl.

| | |
|---|---|
| ***H05K 5/03*** | (2006.01) |
| ***H05K 5/00*** | (2006.01) |
| ***A47L 15/42*** | (2006.01) |
| ***D06F 39/00*** | (2006.01) |

(52) U.S. Cl.

CPC ..... *H05K 5/0017* (2013.01); *A47L 15/4293* (2013.01); *D06F 39/005* (2013.01)

(58) Field of Classification Search

CPC ..... A47L 15/4293; H05K 5/0017

See application file for complete search history.

(56) References Cited

U.S. PATENT DOCUMENTS

| | | | | |
|---|---|---|---|---|
| 4,791,258 | A * | 12/1988 | Youtz et al. | 200/302.1 |
| 5,243,453 | A * | 9/1993 | Kawaguchi et al. | 349/60 |
| 5,453,586 | A * | 9/1995 | Stottmann | 200/5 R |
| 7,968,795 | B2 * | 6/2011 | Yang | 174/67 |
| 8,049,121 | B2 * | 11/2011 | Kleinlein et al. | 200/296 |
| 8,530,742 | B2 * | 9/2013 | Hite et al. | 174/50 |
| 2004/0169449 | A1 * | 9/2004 | Kim | 312/228 |
| 2005/0073628 | A1 * | 4/2005 | Morsch | 349/67 |
| 2006/0089732 | A1 | 4/2006 | Range | |
| 2008/0196749 | A1 | 8/2008 | Kim | |
| 2008/0202790 | A1 * | 8/2008 | Fabrizi et al. | 174/66 |
| 2011/0181516 | A1 * | 7/2011 | Mallory et al. | 345/173 |
| 2013/0056146 | A1 * | 3/2013 | Winkelmann et al. | 156/275.5 |

FOREIGN PATENT DOCUMENTS

| | | | |
|---|---|---|---|
| DE | 19610687 | A1 | 9/1997 |
| DE | 102005024934 | A1 | 12/2006 |
| DE | 102011050752 | A1 | 12/2012 |
| EP | 1283105 | B1 | 11/2004 |
| EP | 2333421 | A1 | 6/2011 |
| EP | 2057418 | B1 | 3/2014 |

* cited by examiner

*Primary Examiner* — Anthony Q Edwards

(74) *Attorney, Agent, or Firm* — James E. Howard; Andre Pallapies

(57) ABSTRACT

A domestic appliance with at least one display window with an externally visible, at least partially transparent viewing area for program data or similar information is produced with in a multi-component process and constructed so that the display window has at least one frame fixedly connected with the viewing area for affixing the display window to parts of a housing of the domestic appliance.

19 Claims, 3 Drawing Sheets

DOMESTIC APPLIANCE WITH AT LEAST A DISPLAY WINDOW

BACKGROUND OF THE INVENTION

The invention relates to a domestic appliance with at least a display window for program data or similar information, wherein the display window includes an at least partly transparent, externally visible viewing area.

It is known to provide domestic appliances such as dishwashers, washing machines, dryers, freezers and the like with display windows that can be used to display the date, time, temperature, selected program, energy and water consumption, remaining time, current program step, any error messages and/or other data. Several such display windows can be provided on a device. In particular, so-called white goods domestic appliances are equipped in this manner.

One problem is, on one hand, to attain a high transparency of the display window—if possible to the edge—and, on the other hand, to embed the display window in a receiving housing part, for example, a front plastic panel, as media-tight as possible. For example, when a display window is inserted on the outer edge of its backside into the receiving housing part from the front and then bonded and/or welded thereto, a blurred edge region is produced at that location which prevents a straight boundary in relation to the actual viewing area and thus results in an untidy image. For this reason, such display windows are frequently inserted into such panel from behind and welded or glued with their front edge. However, the window is then surrounded by the panel, resulting in a relatively small visual impression of the window surface. Moreover, there is often little space behind the panel, making installation from the back impossible. However, a liquid-tight seal cannot be achieved when the display window is only snapped in or clamped. Moreover, a flush position of the outer window surface in the panel is difficult to achieve over the entire surface. High installation costs are incurred when a finished window is first back-injected at the edge with a film, with this film then covering the weld seam.

The invention addresses this problem and strives to find an improvement.

BRIEF SUMMARY OF THE INVENTION

According to an aspect of the invention, a domestic appliance includes a housing, at least one display window having at least one frame and an externally visible, at least partially transparent viewing area for program data or similar information, wherein the at least one frame is fixedly connected with the viewing area and operates to affix the at least one display window to a part of the housing of the domestic appliance. The display window is produced by a multi-component process.

With the invention, a domestic appliance is provided which allows, on one hand, a large viewing area by producing the display window with a multi-component method which provides an integral intimate connection between a viewing area and a frame connected with at least the viewing area for affixing the display window on parts of a housing of the domestic appliance and which allows, on the other hand, assembly from the front side of the panel, thereby minimizing the space requirement behind the panel, while at the same time dispensing with a costly and complex in-mold process. The entire display window can be glued and/or welded to the receiving area of the panel from the front, so that a force applied from the front always acts in the direction of the adhesive bond or weld and, unlike with an assembly from the backside, does not attempt to detach the parts from one another.

The frame may in particular extend along the entire periphery and may thus be welded to the housing part, in particular to a plastic panel, fully media-tight, without rendering the welded region visible from the outside through the viewing area.

To enable a technically simple and effective production, the frame and the viewing area are formed in a so-called 2K-process, which obviates the need for molding additional retaining means or screens. A single process step is sufficient for producing the entire assembly of the display window.

When the frame is located at the backside of the viewing area, the frame can have a particularly large area, which gives it a sophisticated appearance. The display window then appears to be larger than the so-called active area and may, for example, extend to the edges of the panel.

Advantageously, the frame forms a completely closed, uninterrupted contour behind the partially transparent plastic surface, thus forming a circumferentially sealing contact with the panel.

For example, the—inherently opaque—frame may be made from a stable ABS and may be formed together with a viewing area made from, for example, a polycarbonate or PMMA in a 2K-process.

The assembly is further facilitated when the frame is provided with centering ribs or other centering aids for precise alignment on the receiving housing part.

To simplify the production, a recess may be provided in the frame as one way of molding the viewing area, wherein the recess does not completely interrupt the frame.

Advantageously, the frame may have a welding material source protruding from the backside and encompassing the viewing area. The welding material source may hereby be covered by the frame and protrude toward the backside approximately perpendicular to the front face of the viewing area, so as to rest on the receiving housing part during welding and being melted on its outer edge for connection to the housing part.

Regarding the visual appearance, the viewing area forms a stepped translucent body having a rearward step that is recessed from its outer edge and encompassed by the frame. Due to the substantial thickness of this step, the display elements may then be placed in very close proximity behind this part of the translucent body and thereby provide a visual appearance as if they were arranged in the translucent body itself.

Due to the intimate connection during the manufacture, the frame is penetrated by the step liquid-tight and air-tight.

When only the frame is in intimate contact with a receiving housing part in the installed position, the viewing area may remain up to its outer edge without any visual impairment and without departing from a clear, continuous appearance.

When the receiving housing part is formed by a recess in a front panel, the front panel may be made from a material that is particularly suitable for being welded to the frame.

In any case, an air-tight and/or water-tight weld and/or adhesive joint of the frame with the receiving housing part is possible which promotes durability without a risk of incursion.

In particular, such domestic appliance may be a major appliance, such as a dishwasher.

BRIEF DESCRIPTION OF THE DRAWINGS

Further advantages and features will be described below in form of exemplary embodiments of the object of the invention with reference to the drawing.

The drawing shows in.

DETAILED DESCRIPTION OF EXEMPLARY EMBODIMENTS OF THE PRESENT INVENTION

Figure 1:
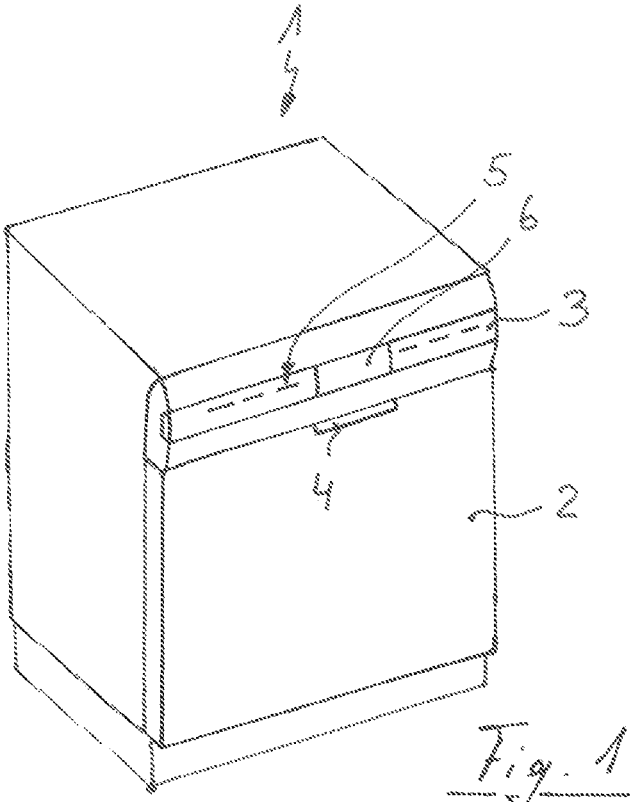
FIG. 1 a domestic appliance, here a dishwasher, in a perspective view with a front panel in which a display window is inserted from the front, FIG. 2 a detailed view of a possible front panel prior to assembly in a perspective view, with the later front side pointing upward, FIG. 3 an exploded view of a display window in the position in FIG. 2, before its insertion into the panel, FIG. 4 a front view of the display window of FIG. 3, approximately corresponding to a view from the direction IV in FIG. 3, FIG. 5 the display window in a position inverted with respect to FIG. 3, with its backside pointing upward.
Figure 4:
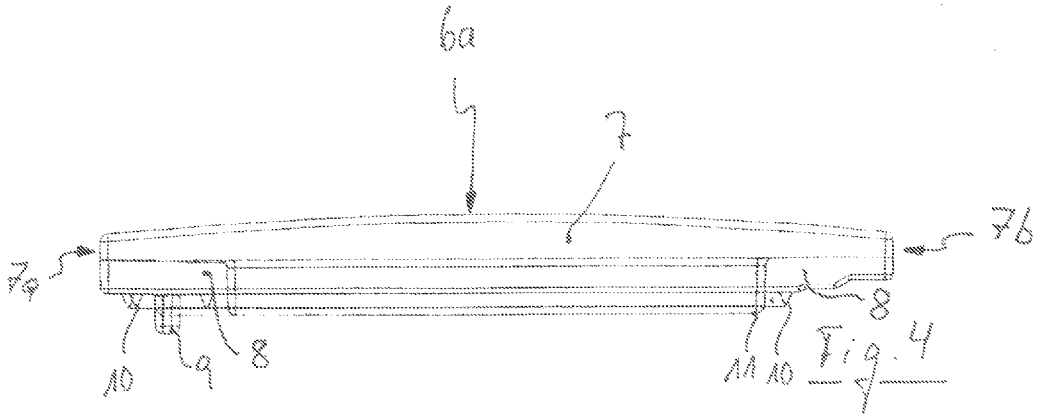
Figure 3:
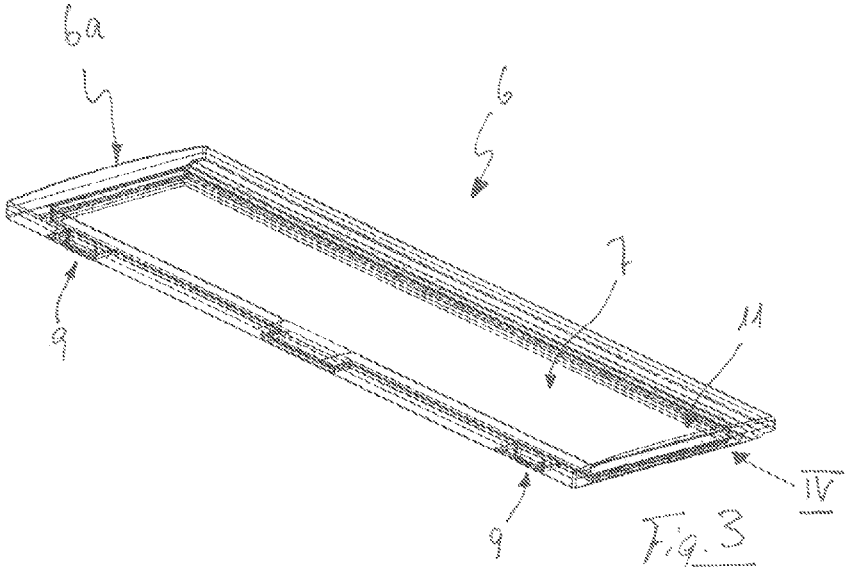
Figure 2:
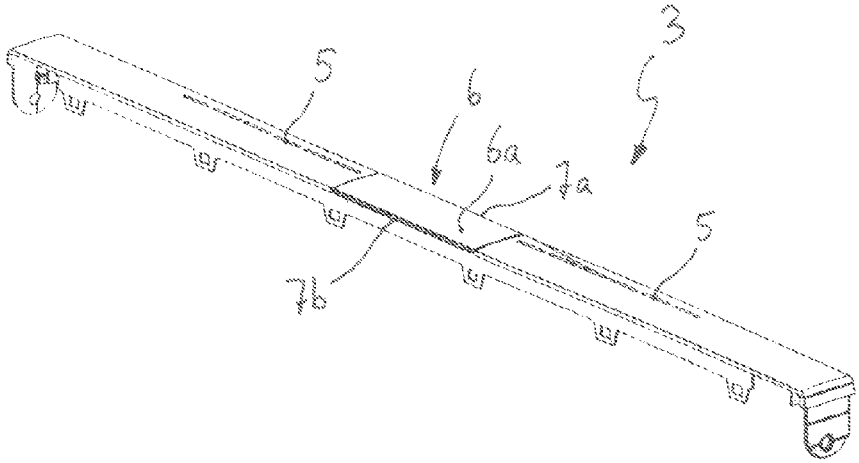
Figure 5:
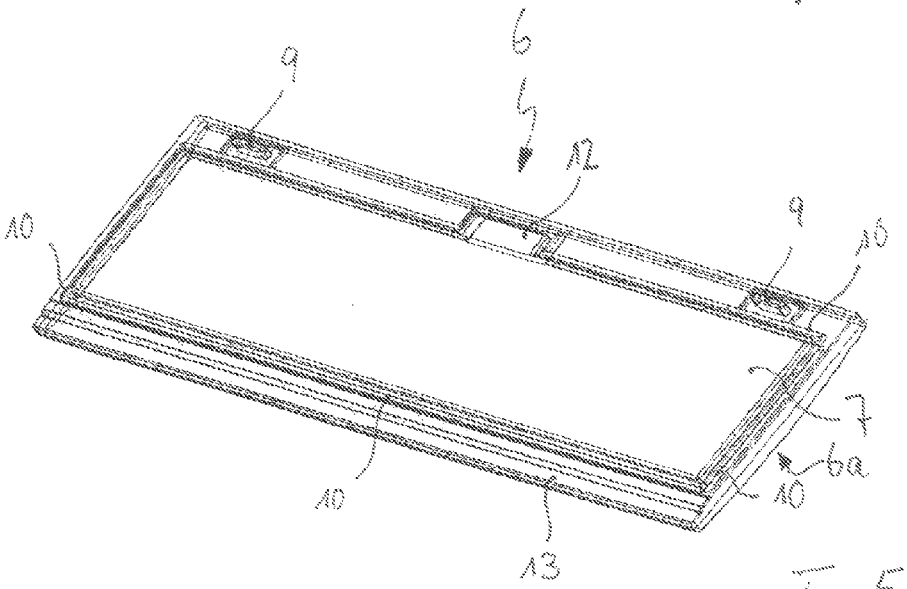

Elements with the same function and operation are provided in the figures with the same reference characters.

The domestic appliance 1 schematically illustrated in FIG. 1 is embodied here, for example, as a dishwasher. As described above, other domestic appliances, especially large appliances, may also be considered as part of an exemplary embodiment.

The illustrated domestic appliance 1 has a front door with a door handle 2 and a fixed region arranged above and carrying a panel 3. The door 2 is shown in FIG. 1 in the closed position and can be pivoted, for example, to the front and downwards about a lower horizontal axis. Alternatively, the panel 3 can also be embedded in the door 2, in particular with so-called built-in dishwashers.

The panel 3 may include several operating elements 5 in different numbers and arrangements—for example push-buttons, sensor surfaces, rotary switches . . . —and at least one display window 6. Here, exactly one display window 6 is provided which is flush with the outer surface of the panel 3, and which has a convex outer surface 6*a* that matches the panel and points to the front in the installed position and is therefore easily visible to a user. The outer surface 6*a* has here a rectangular outside contour, which however is not mandatory and may vary depending on the design of the appliance 1. For example, a circular display window may also be feasible. Likewise, the convex curvature is also not mandatory, so that the design may be adapted to the surrounding housing parts. An additional decorative frame may be provided around the display window 6—also a shroud or another connection with other functions.

The display window 6 is used to display, for example, date, time, temperature, the selected program, energy and water consumption, remaining running time, current program step, any error messages and/or other data. A function of an external energy source or energy storage device, for example, of a solar heating system, can be displayed in the display window 6.

For this purpose, the display window designated overall with the reference symbol 6 includes an externally visible, at least partially transparent viewing area 7, which may be formed, for example, from a transparent plastic material such as PC and PMMA. This area may also be tinted—for example with a blue tint.

The display window 6 may be inserted from the front into a panel 3 or any other area of the housing of the domestic appliance 1 and connected therewith water-tight and air-tight.

The display window 6 is hereby produced with a multi-component process and includes at least one frame 8 which is fixedly connected with the viewing area 7 for securing the display window 6. The display window 6 is then secured on parts of a housing of the domestic appliance 1 only by way of the frame, whereas the viewing area is unaffected by welding and/or adhesive residues.

The frame 8 and viewing area are hereby formed particularly effectively in a single process step in a so-called 2K process.

The frame 8 is here located substantially at the backside of the viewing area 7 and is thus not directly visible from the outside, but only through the transparent area of the viewing area 7.

The frame 8 is constructed, for example, from ABS or from another suitable opaque, dimensionally stable material, which provides a permanent and tight connection to the panel 3, and forms a fully closed peripheral contour behind the viewing area 7. Because the frame 8 is manufactured with the multi-component process, it is integrally connected with the viewing area 7 over the full area around the entire periphery. An exemplary recess 12 is provided in the frame 8 for the purpose of manufacturing the two components to allow molding of the at least partially transparent plastic surface of the viewing area 7.

The translucent body 7 is stepped and has toward the backside (in relation to the installation position) a step 11 which is recessed from its outer edge and encompassed by the frame. This step 11 may extend so far back that it protrudes in the installation position farther to the backside than the frame 8. This allows the viewing area 7 to be located extremely close in front of the display elements located underneath, giving the impression that the display elements are embedded in the translucent body 7.

The contact area between the frame 8 and translucent body 7 is completely air-tight and liquid-tight due to the integrated 2 k-production of these parts, so that the frame 8 is also penetrated liquid-light and air-tight by the step 11.

To facilitate alignment of the frame 8 that is to be connected to the housing part 3, the frame may be provided with centering ribs 9 or similar alignment aids constituting an integral component of the frame 8. Naps or other centering aids in various numbers may also be used instead of the ribs 9, which cooperate with corresponding complementary counterparts—not illustrated—of the panel 3 when the display window 6 is assembled.

The frame 8 has here a rearward protruding welding material source 10 extending around the periphery of the viewing area 7, which is constructed in cross-section as a wedge-shaped tapered line which is placed onto the housing part 3 from the front to provide a media-tight connection with the housing part 3; the tapered region of the line 10 is hereby placed on a corresponding mating surface of the housing part 3 and welded, for example by applying ultrasound. A sonotrode is hereby pressed against the front surface 6*a* from the front, so that the display window 6 is inserted into the area 3 from the front and welded media-tight to the frame 8 by way of the line 10 of the frame 8. When the process is terminated, the line 10 is then fused to an extent so that its height is somewhat reduced and the outer surface 6*a* lies flush against the outer surface of the panel 3.

In the installation position, only the frame 8 is thus connected to a receiving housing part 3 via the welding material source, leaving the viewing area completely free from adhesive or welding residues, with only the front side of the inherently opaque frame 8, but not its connection with the housing part 3 at the backside, being visible when viewed from the front. In particular, the upper and lower edges as well as the lateral edges of the viewing area 7 may extend beyond the frame, resulting in a frameless and large optical effect of the display window 6. When using the illustrated narrow panel 3, the top and bottom edge of the display window 6 may thus also be flush with the top and bottom edge of the panel 3. To this end, the upper and lower edge 7*a*, 7*b* may also be slightly rounded. In any case, the display window 6 can be very large and can indeed be larger than the actual active area, giving the customer the impression of a larger display. The space behind the display window remains unrestricted. Additionally, the frame 8 may also have a step 13 as a sealing bed contour.

The receiving housing part is here formed, as already described, by a recess in a front panel 3. Other geometries may also be considered. In any case, the frame 8 is—unlike with a snap-in connection—welded and/or glued to the receiving housing part 3 air-tight and/or water-tight. This significantly improved the durability of the electronic components arranged behind.

What is claimed is:

1. A domestic appliance, comprising a housing, and at least one display window having at least one frame and an externally visible, at least partially transparent viewing area for program data or similar information, wherein the at least one frame is fixedly connected with the viewing area to form a permanent connection between the frame and the viewing area, the frame operating to affix the at least one display window to a part of the housing of the domestic appliance, wherein the display window is produced by a multi-component process, and wherein the viewing area comprises a step which is recessed rearward from an outer edge of the viewing area and encompassed by the at least one frame.

2. The domestic appliance of claim 1, wherein the at least one frame and the at least partially transparent viewing area are formed in a so-called 2K-process.

3. The domestic appliance of claim 1, wherein the at least one frame is located substantially at a backside of the viewing area.

4. The domestic appliance of claim 1, wherein the at least one frame forms a completely closed contour behind the viewing area.

5. The domestic appliance of claim 1, wherein the at least one frame is made from ABS.

6. The domestic appliance of claim 1, wherein the at least one frame comprises centering ribs for alignment with a part of the housing.

7. The domestic appliance of claim 1, wherein the at least one frame comprises a welding material source projecting from a backside of the at least one frame and encompassing the viewing area.

8. The domestic appliance of claim 1, wherein the at least one frame comprises a recess enabling the viewing area to be molded.

9. The domestic appliance of claim 1, wherein the step passes through the at least one frame in a liquid-tight and air-tight fashion.

10. The domestic appliance of claim 1, wherein in an installed position only the at least one frame is in contact with the part of the housing.

11. The domestic appliance of claim 1, wherein the housing part to which the at least one frame is affixed is formed by a recess in a front panel of the housing.

12. The domestic appliance of claim 11, wherein the at least one frame is affixed to the housing part by at least one of welding and gluing so as to be air-tight or water-tight, or both.

13. The domestic appliance of claim 1, wherein the domestic appliance is a dishwasher.

14. A method of constructing a display window for a domestic appliance comprising:

manufacturing a multicomponent display window in a single process step, the multicomponent display window having a first at least partially transparent component and a second opaque, dimensionally stable component;

providing the first component with a backwards facing step portion;

providing the second component with a frontwards permanent, integral connection with the first component around the periphery of the backwards facing step portion;

providing a bonding material on a backwards facing face of the second component;

aligning the multicomponent display window with a provided corresponding and complementary location on a housing part of the domestic appliance;

installing the multicomponent display window into the provided complementary location on the housing; and activating the bonding material after the multicomponent display window has been aligned and installed into the provided complementary location on the housing to create a permanent connection between the second component and the housing part.

15. The method of claim 14, wherein the single step process is a 2 k process.

16. A display window for a domestic appliance, comprising:

a first, at least partially transparent component;

a second opaque, dimensionally stable component integral with and permanently affixed to a rear surface of the first component; and a bonding material provided on a rear surface of the second component;

wherein: the display window is configured to align with and be installed in a complementary location on a housing part associated with the domestic appliance;

the second component is configured to be absent from a central section of the first component such that a transparent section of the first component remains unobstructed by the second component and the bonding material; and the bonding material provides a permanent and tight connection between the second component and the housing part of the domestic appliance when placed in contact with the housing part and activated.

17. The display window of claim 16, wherein:

the first component further comprises a first front portion and a second rearwardly projecting portion;

further wherein the second rearwardly projecting portion is a step projecting through the central section where the second component is absent.

18. The display window of claim 17, wherein the second rearwardly projecting portion of the first component extends farther rearward than the thickness of the second component.

19. The display window of claim 16, wherein the second component is provided with alignment components configured to align the display window with the housing part.

* * * * *